US005860335A

United States Patent [19]

Lund

[11] Patent Number: 5,860,335

[45] Date of Patent: Jan. 19, 1999

[54] TORQUE TRANSFER DEVICE WITH ADJUSTMENT APPARATUS

[76] Inventor: David R. Lund, 435 Dickey Rd., E. Corinth, Utah 05040

[21] Appl. No.: 651,895

[22] Filed: May 21, 1996

Related U.S. Application Data

[63] Continuation-in-part of Ser. No. 284,080, Aug. 1, 1994, Pat. No. 5,586,474, and Ser. No. 242,196, May 13, 1994, Pat. No. 5,540,122, which is a continuation-in-part of Ser. No. 75,787, Jun. 14, 1993, abandoned.

[51] Int. Cl.[6] ..... B25B 17/00

[52] U.S. Cl. ..... 81/57.3; 81/57.43

[58] Field of Search ..... 81/57.13, 57.14, 81/57.3, 57.43

[56] References Cited

U.S. PATENT DOCUMENTS

| | | | |
|---|---|---|---|
| 141,259 | 7/1873 | Bubser | 81/57.3 |
| 3,138,983 | 6/1964 | Frizzell | 81/57.3 |
| 3,714,852 | 2/1973 | Giangrasso | 81/57.3 |
| 5,540,123 | 7/1996 | Lund | 81/57.3 |

FOREIGN PATENT DOCUMENTS

| | | | |
|---|---|---|---|
| 2108029 | 5/1983 | United Kingdom | 81/57.3 |

*Primary Examiner*—James G. Smith
*Attorney, Agent, or Firm*—B. Craig Killough

[57] ABSTRACT

A torque transfer device allows torque to be input at one point of the device and transferred to another point of the device at which the power or torque can be taken from the device. The device incorporates a direct drive means comprised which communicates with drive gears. An adjustment device which the drive gears allows for repositioning of the drive gears to accommodate wear or other expansion of the direct drive means.

6 Claims, 10 Drawing Sheets

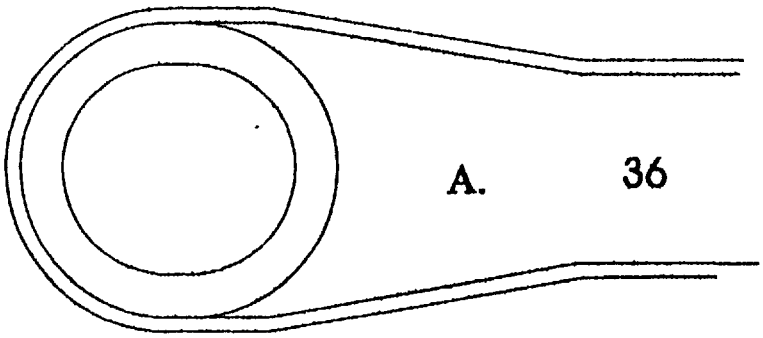
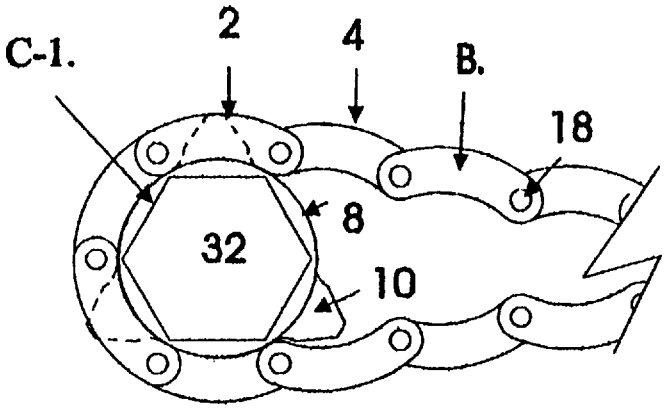
fig 5 flg 8

TORQUE TRANSFER DEVICE WITH ADJUSTMENT APPARATUS

This application is a continuation-in-part of application Ser. No. 08/284,080 filed Aug. 1, 1994 U.S. Pat. No. 5,586,474, and a continuation-in-part of application Ser. No. 08/242,196 filed May 13, 1994, U.S. Pat. No. 5,540,122, which is a continuation-in-part of application Ser. No. 08/075,787, filed Jun. 14, 1993, now abandoned.

FIELD OF THE INVENTION

This invention relates to a device for transferring torque by continuous loop direct drive means which transfers torque from a first drive gear to a second drive gear, and is particularly directed to a device for the transfer of relatively high torque within a confined space, or where the device is enclosed in a relatively small housing.

BACKGROUND OF THE INVENTION

There are many devices which transfer torque, or rotational velocity, from one point to another. Chains, belts and similar direct drive means transfer rotational movement from one gear or pulley or similar drive means to a second or subsequent gear or pulley or similar driven means.

In some applications, it is desirable to transfer relatively high torque from one point to another point, or from one device to another device. In such applications, space limitations may be a factor. The relatively high torque to be transferred may preclude the use of torque transfer devices which cannot handle heavy duty loads, while space does not permit the use of large devices.

An example of such space limitations are torque transfer devices which are placed within enclosures. Examples of devices which transfer relatively high torque are tools which are used to tighten fasteners by the application of torque. Engines and motors use torque transfer devices both operationally, such as camshaft drives, and as power take off devices, such as chain drives on motorcycles. High torque and limited space is a factor in such devices.

Various wrenches, extensions, ratchets, adapters and power transfer tools and devices are disclosed in the prior art. Similarly, camshafts and similar devices are driven by the application of relatively high torque where space for the application of the drive means is limited. Problems are encountered with such devices where the devices are enclosed in relatively small housings, or are otherwise required to be relatively compact in comparison to the torque to be transferred. Common problems experienced with the devices of the prior art include friction and wear between the housing of the device and the drive means, inadequate strength of the drive means or gears, and inadequate or improper engagement of the drive means and the gears due to space limitations.

A additional problem which is experienced relates to stretching of the drive means. The drive means is subjected to substantial forces as power is transferred from one drive gear to the other drive gear. Over time, the drive means will stretch, causing problems in the operation of the device.

SUMMARY OF THE PRESENT INVENTION

The present invention is a device which transfers torque from one point to a second remote point of the device. A drive means or drive tool inputs torque into the device at a first point, and the rotational movement, and torque, is taken, or harvested, from the second remote point. Typically, the transfer of the rotation by the tool will be along a path of travel which is not on the same axis as the rotation of the drive tool.

The invention incorporates a direct drive means which connects a first drive sprocket to a second drive sprocket. The first sprocket rotates as torque is applied to the first sprocket, and as the direct drive means is engaged by the first sprocket, the direct drive means engages the second drive sprocket, causing it to rotate.

The direct drive means is comprised of a plurality of links connected to form a continuous loop. The links are joined end to end and pivot relative to each other. Some of the links, usually each alternating link, has an orifice which receives a tooth or teeth of the drive sprocket as the link rotates through the sprockets.

DESCRIPTION OF THE DRAWINGS OF THE PREFERRED EMBODIMENT

FIG. 5 shows a partial view of a housing, and shows the corresponding engagement of a direct drive means with a drive sprocket.

DESCRIPTION OF THE PREFERRED EMBODIMENT

Figure 1:
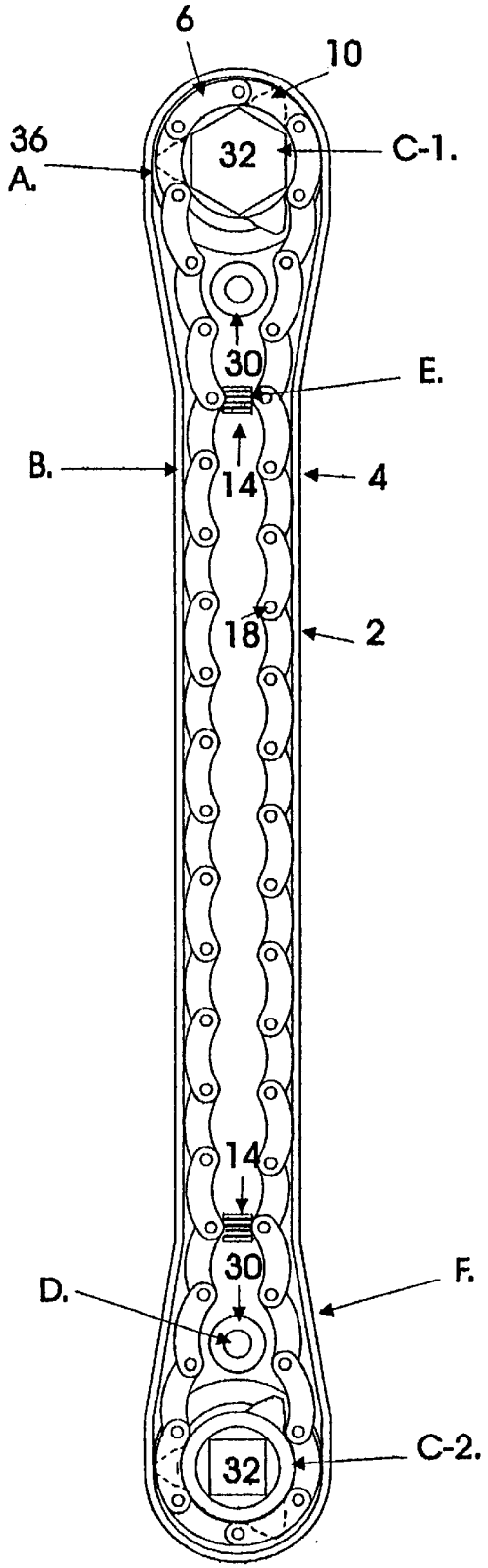
FIG. 1 is a top plan view of the device with one half of the housing removed to show the drive sprockets, direct drive means, and a portion of the housing.

The present invention is characterized by a direct drive means which is driven by a first drive sprocket, or gear, or pulley, or similar rotational device, which, in turn, drives a second drive sprocket, or gear, or pulley, or a similar rotational device. The direct drive means then transfers torque from a first rotating member to a second, or perhaps subsequent, rotating member. Referring now to the drawing figures, FIG. 1 shows the device with one half of the housing 36 removed. Each alternating link 2 of the direct drive means 6 receives the teeth 10 of a drive sprocket 8 as the direct drive means rotates through the drive sprocket.

The continuous direct drive means may be formed by a series of alternating links 2 which are connected to one of each of the remaining links 4 at each end, until a continuous loop of the required length is formed. The links are pivotally connected, so that the links pivot relative to each other. The connecting member may be a pin 18 which is inserted to join the links. The pin may be fixed in the two arms of the alternating link, with the remaining link allowed to rotate about the pin.

Each of the links is preferred to have an arcuate shape of constant radius as shown in the drawing figures. Each of the links will usually have the same radius, and be of approximately the same length and width. The links have a bottom surface 20 of constant radius and a top surface 22 of constant radius, which makes up the generally arcuate shape of the links. For the purpose of this disclosure, the bottom surface of the link is defined as the surface of the link which adjoins the drive sprocket, while the top surface of the link is opposite the drive sprocket. The links may be formed of generally parallel plates. As shown in the drawing figures, each alternating link has four plates, and the remaining links have three parallel plates.

Figure 6:
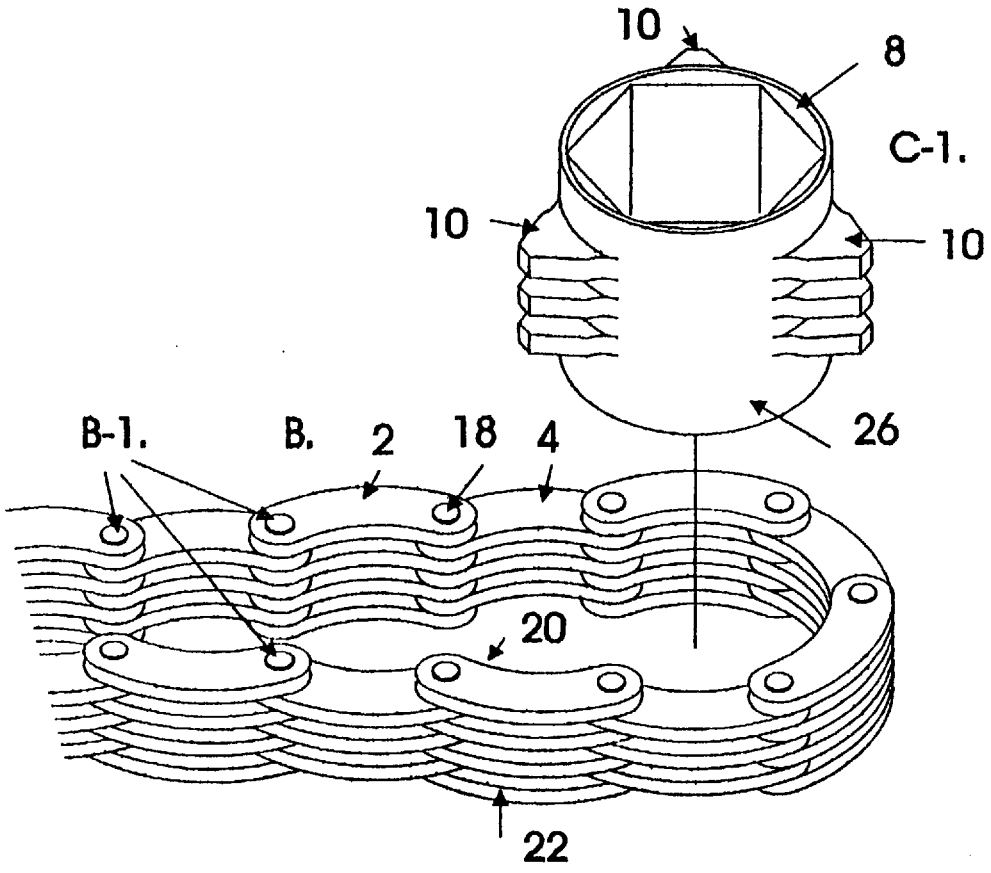
FIG. 6 shows a portion of a direct drive means with a drive sprocket shown as exploded from the direct drive means.
Figure 7:
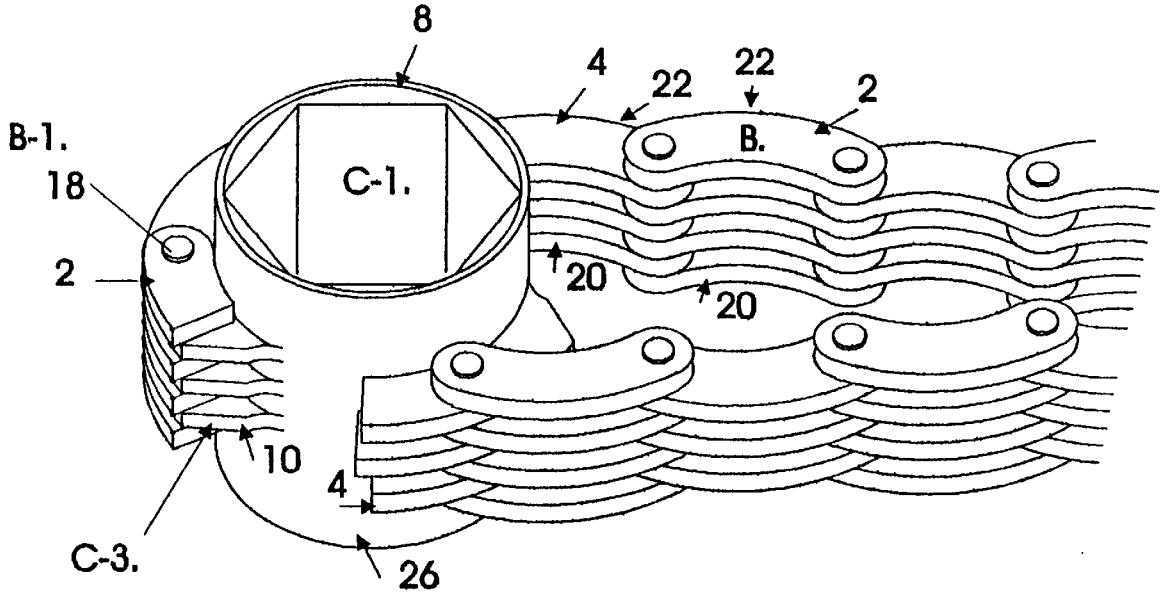
FIG. 7 shows a portion of a direct drive means as it engages a drive sprocket, with a portion of the direct drive means cut away.
Figure 8:
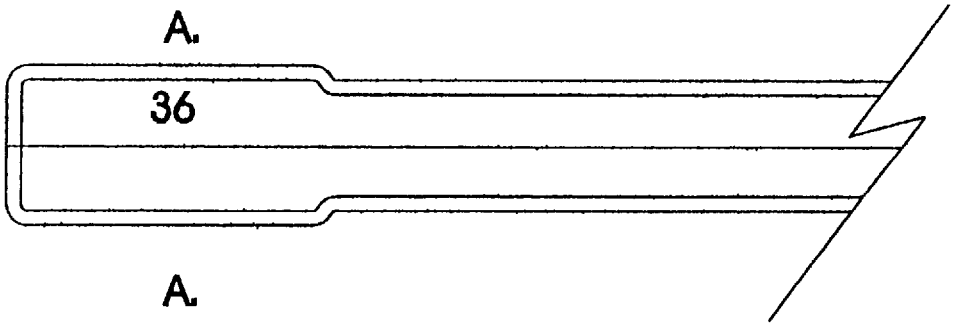
FIG. 8 is a side elevation of a portion of the housing.
Figure 9:
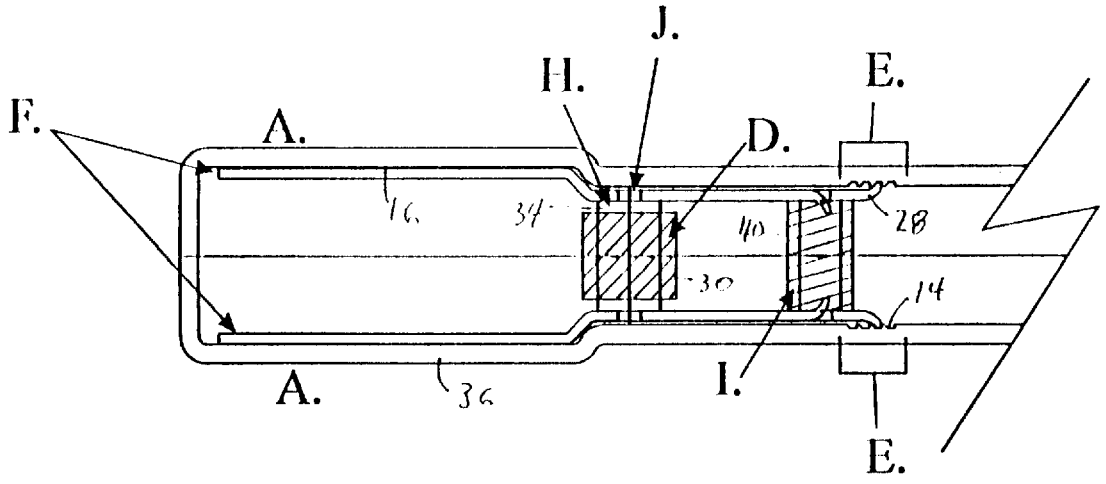
FIG. 9 is a sectioned view of the housing showing the adjustment device.
Figure 10:
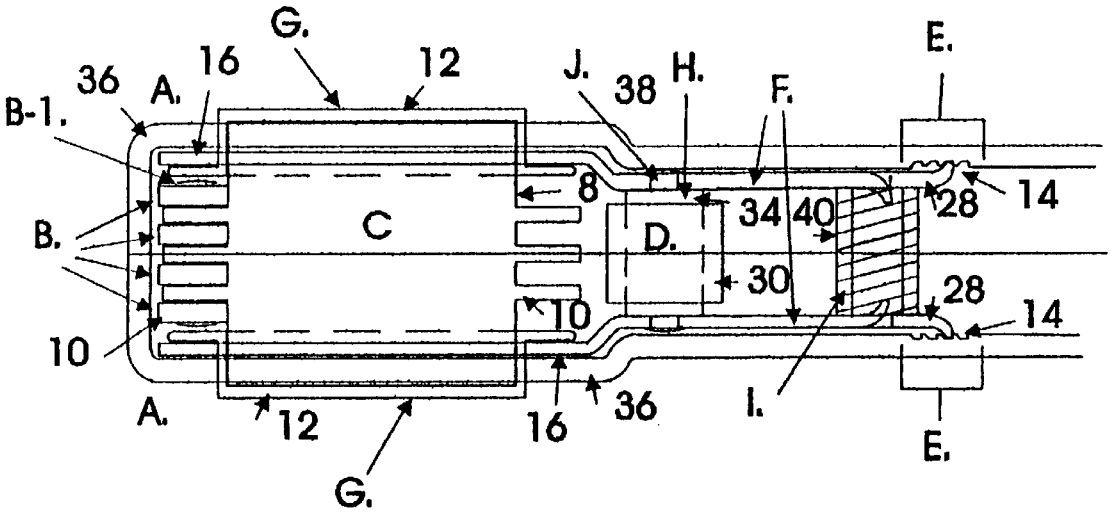
FIG. 10 is another view of the device as shown in FIG. 9, further showing a drive sprocket positioned therein.

The links are pivotally joined end to end to form a continuous loop. The end of the link is defined as the part of the link which is attached to or joins with the next, or adjoining, link. The continuous loop direct drive means rotates through a first drive sprocket and a second drive sprocket. The relationship between a drive sprocket and the direct drive means is shown with particularity in FIGS. 5, 6, and 7. The drive sprocket has an outer circumference 26. This outer circumference is of a radius which is generally the same as the radius of the bottom surface 20 of the links. The outer circumference forms a circle. A plurality of teeth 10 extends radially from the drive sprocket, and more specifically, from the surface which forms the outer circumference of the drive sprocket. Each of the teeth may be comprised of a plurality of generally parallel plates.

Typically, the drive sprockets will have a void 32 in the center which provides a means by which the drive sprocket may be driven, and power may be taken from the drive sprocket. The void may be provided in the drive sprocket for insertion of a drive means to drive the drive sprocket, and a void may be provided on the remaining drive sprocket for insertion of a driven means, or power takeoff means.

Commonly, the present invention will be used with hand tools or power tools. Hand tools and power tools in use commonly use six point, or hexagonal, engagement means, or twelve point engagement means. Accordingly, the device as shown has three teeth extending from the drive sprockets. In use, a sprocket is rotated by application of torque from another rotating device, or drive means. The rotating device could be any known tool, including a wrench, ratchet, screwdriver, or a power tool, a motor, or a transmission, or other device which will apply a rotational force to the sprocket. The rotation of the direct drive means by the first sprocket causes rotation of the second sprocket. In this manner, torque is transferred to the second sprocket. Power take off means may be supplied, and application means, such as a tool, a generator, a pump, or other device which is actuated by the application of torque could be used. For the purpose of increasing or decreasing torque, or increasing or decreasing rotational speed, sprockets of different effective diameters could be employed, if space permits.

The direct drive means rotates through each sprocket, either driving, or being driven by, the sprocket. Each of the alternating links engages one of the teeth of the drive sprocket as the direct drive means rotates through the sprocket. The bottom arcuate surface of the links contact the outer circumference of the drive sprocket. The bottom arcuate surface of the links is approximately the same radius as the radius of the surface of outer circumference of the drive sprocket. The device may be contained within a housing 36. The housing may be elongated. The arcuate shape of the top surface of the links facilitates the rotation of the device within the housing, which will usually have an enlarged sprocket housing of constant radius on each end, as shown in FIGS. 2 and 5.

The length of the direct drive means is critical. Due to the large number of links, small deviations add up. An adjustment means may be included. The adjustment means allows one or both of the sprockets to be selectively positioned toward either end of the device to take up slack in the direct drive means as needed.

Figure 2:
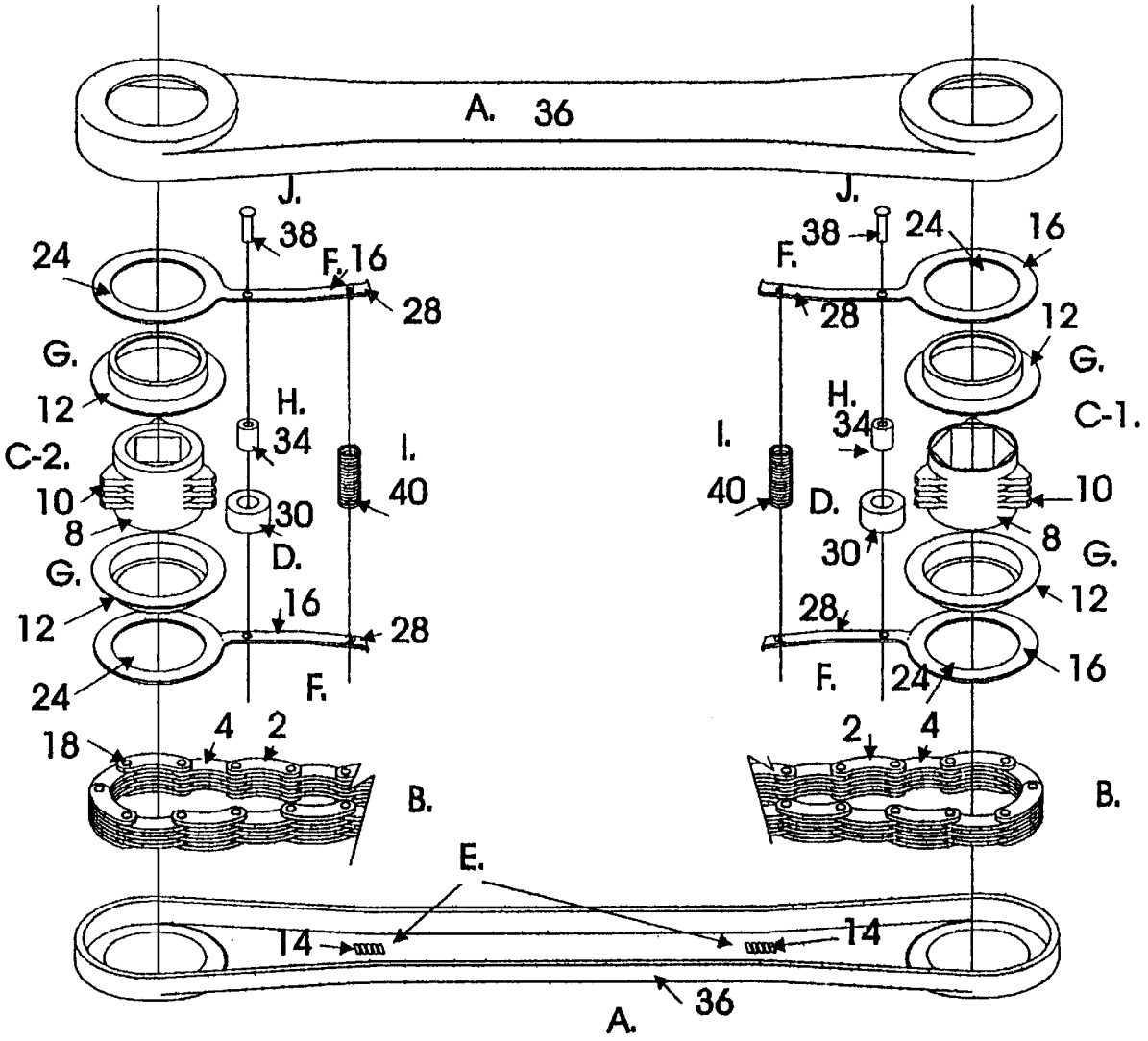
FIG. 2 is an exploded view of the device.
Figure 3:
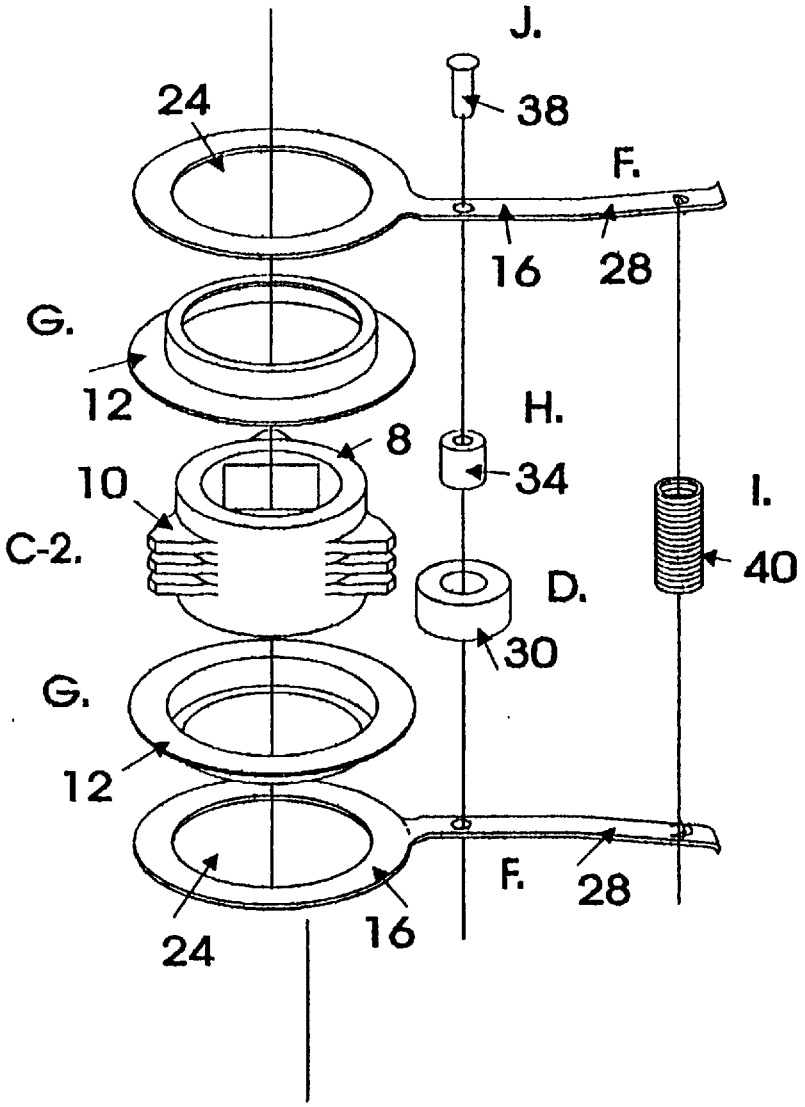
FIG. 3 is an enlarged view of a drive sprockets and the adjustment apparatus shown in FIG. 3.
Figure 4:
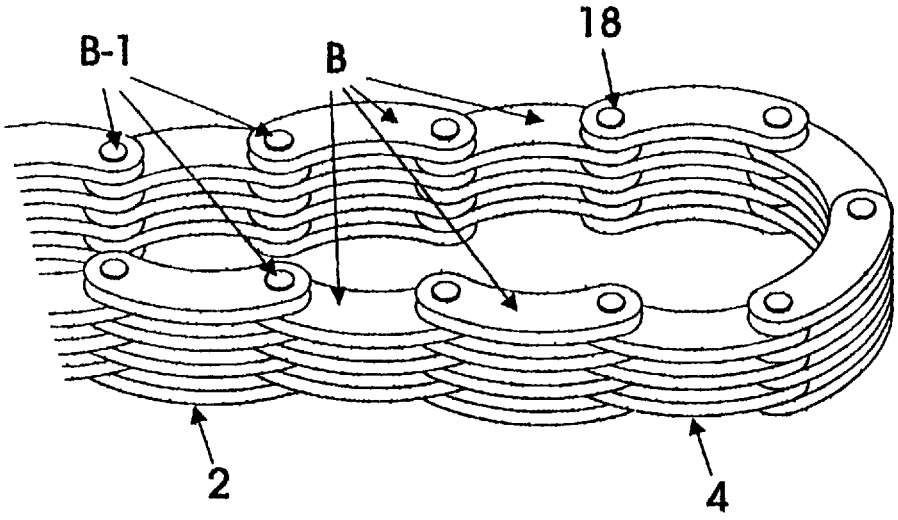
FIG. 4 is a partial view of a direct drive means.

FIG. 2 shows an exploded view of the device. The housing 36 is shown in two parts, with the housing split in half for access. Also shown are the direct drive means 6, and the sprockets 8, with one sprocket having a void for a rectangular drive, and the remaining sprocket having a hexagonal void for power take off. Sprocket caps 12 are also provided.

The remaining details of FIG. 2 relate to the adjustment apparatus. In the preferred embodiment, four series of channels 14, or adjuster seats, are formed in the housing. Two adjuster seats correspond to each sprocket, with one series of channels formed in the upper portion of the housing, and one series of channels formed in the lower portion of the housing for each sprocket. Two adjusters 16 are provided for each sprocket. One adjuster is positioned above, and one adjuster is positioned below, each sprocket, or more particularly, each sprocket cap. In the preferred embodiment, the adjuster has an annular void 24 on one end which engages the sprocket cap. A pawl 28 extends from the adjuster toward the opposite sprocket. The pawl engages one of the channels of the series of channels in the adjuster seat. Each of the series of channels correspond to one of the adjusters, as shown in the drawing figures.

Rollers 30, which may be mounted on roller sleeves 34, are used to facilitate the movement of the direct drive means through the housing and the gears. A rivet 38 is used to hold the assembly together, and spring biasing 40 means located between the adjusters is provided to keep each pawl position within the selected channel.

As the direct drive means begins to lengthen due to normal use and wear, the accompanying slack which is experienced may be removed from the direct drive means by the adjustment device. The housing is separated, and the pawl is moved to a channel which is further away from the opposite sprocket. Since the adjusters communicate with the sprocket, the sprocket is thereby moved further away from the opposite sprocket, effectively tightening the direct drive means. The use of the adjustment device on each end, which is optional, allows for substantial adjustment and tightening of the drive means. By periodically removing slack from the direct drive means, the efficiency of the operation of the device is maintained.

The housing may have various shapes, although the dog bone shape shown is best for most applications. An object of the present invention is to provide a device which will transfer torque to a point where there is difficulty in positioning a drive. The use of various shapes, including straight lines and arcs for the housing furthers this object of the invention.

A primary goal of the present invention is to provide a torque transfer device which may be used in applications where a great amount of torque is to be transferred, but operational space is limited. Accordingly, the configuration of the direct drive means is critical to the invention, and the use of the arcuate shaped individual links of constant radius accomplishes a goal of the invention. The arcuate shaped links form a partially circular shape as they rotate through the sprockets, thereby minimizing the space occupied when compared to other possible configurations. The arcuate top surfaces of the links have no extensions or protrusions, and the shape of the top surface minimizes friction in the event of contact of the links with a housing or other environment in which the device is used. While the device is very space efficient, the structure of the links provides a direct drive means which is extremely strong and capable of carrying high torque loads, with minimal loss of energy due to friction.

The best mode for using the device is as extension for tools. A drive, such as the drive of a ratchet or air wrench is inserted into the first drive sprocket 23. The direct drive means transfers torque to the second drive sprocket 24, and a socket or other tool can be used to tighten or loosen a threaded fastener at a location which is remote from the wrench. The device is particularly suited to such an application since tools for torquing threaded fasteners must be able to handle high torque, while the space in which such tools are used is frequently limited, meaning that the tool must be as small as possible. Other uses for the device are apparent from the disclosure of the device herein.

It is not necessary that the drive sprockets rotate within the same plane. The application of torque may be directed to position the device to rotate on a plane which is perpendicular to, or otherwise different than, the plane within which the first sprocket rotates. One or more idler sprockets could be used to facilitate such directional change.

What is claimed is:

1. A torque transfer device, comprising:

a. a first drive sprocket and a second drive sprocket;

b. a continuous loop direct drive means which engages each of said first drive sprocket and said second drive sprocket;

c. a housing which surrounds said first drive sprocket, said second drive sprocket and said direct drive means, wherein said housing comprises a plurality of channels on a surface thereof; and d. adjustment means for causing the position of said first drive sprocket to be selectively changed relative to said second drive sprocket, wherein said adjustment means comprises a pawl for engaging said plurality of channels, wherein the position of said first drive sprocket is selectively changed relative to said housing and said second drive means by moving said pawl within said plurality of channels;

wherein said direct drive means provides communication between said first drive sprocket and said second drive sprocket, and wherein rotation of said first drive sprocket causes, in turn, rotation of said second drive sprocket.

2. A torque transfer device as described in claim 1, wherein said adjustment means comprises a member having an annular void therein which is generally concentric with said first drive sprocket, and said pawl extends from said member.

3. A torque transfer device as described in claim 1, wherein said direct drive means comprises a plurality of connected links, and a surface of each of said links has a generally arcuate shape of constant radius, and each of said first drive sprocket and said second drive sprocket has a surface of a constant radius which is substantially the same as the radius of said surface of each of said links, wherein said surface of each of said links engages said surface of said gears as said links rotate through said gears.

4. A torque transfer device as described in claim 3, wherein an opposite surface of each of said links has a generally arcuate shape of constant radius.

5. A torque transfer device as described in claim 2, further comprising a roller which is positioned between said annular void of said member and said pawl.

6. A torque transfer device as described in claim 4, further comprising a roller which is positioned between said annular void of said member and said pawl.

* * * * *